US005352893A

United States Patent [19]

Freedman

[11] Patent Number: 5,352,893

[45] Date of Patent: Oct. 4, 1994

[54] ISOTOPIC-RATIO PLASMA SOURCE MASS SPECTROMETER

[75] Inventor: Philip A. Freedman, Northwich, United Kingdom

[73] Assignee: Fisons plc, Ipswich, England

[21] Appl. No.: 90,205

[22] PCT Filed: Mar. 11, 1992

[86] PCT No.: PCT/GB92/00429

§ 371 Date: Jul. 22, 1993

§ 102(e) Date: Jul. 22, 1993

[87] PCT Pub. No.: WO92/16008

PCT Pub. Date: Sep. 17, 1992

[30] Foreign Application Priority Data

Mar. 11, 1991 [GB] United Kingdom ..... 9105073

[51] Int. Cl.[5] ..... H01J 49/10; H01J 49/32

[52] U.S. Cl. ..... 250/289; 250/281; 250/282; 250/296; 250/298

[58] Field of Search ..... 250/289, 281, 282, 294, 250/296, 298

[56] References Cited

U.S. PATENT DOCUMENTS 3,233,099 9/1963 Berry et al. .
5,068,534 11/1991 Bradshaw et al. ..... 250/296

FOREIGN PATENT DOCUMENTS 125950 10/1984 European Pat. Off. .
490626 10/1991 European Pat. Off. .
WO8912313 12/1989 World Int. Prop. O. .

OTHER PUBLICATIONS

Price Russ III, Bazan Sprechtochim. Acta. 1987 vol. 42B (1–2) pp. 49–62.
Anderson, Gray Proc. Analyt. Div. Chem. Soc., Sep. 1976 p. 284.
Ting, Janghorbani Spectrochim. Acta. 1987 vol. 42B pp. 21–27.
Gregoire, Prog. Analyt. Spectros. 1989, vol. 12 pp. 433–452.
Karlewski, Eberhardt et al Kurri Techn. Report TR-318 pp. 72–76.
Houk, Thompson Mass Spectrom. Reviews, 1988, vol. 7, pp. 425–461.
Douglas, Houk Prog. Analyt, Atom. Spectros, 1985, vol. 8, pp. 1–18.
Douglas Can. J. Spectrosc. 1989 vol. 34, (2) pp. 38–49.

*Primary Examiner*—Jack I. Berman
*Attorney, Agent, or Firm*—Chilton, Alix & Van Kirk

[57] ABSTRACT

An isotopic-ratio mass spectrometer comprises an r.f. or microwave induced plasma ion source (1, 2, 3), an electrostatic ion-energy analyzer (75), a magnetic sector ion-momentum analyzer (82) wherein ions are dispersed at a first potential according to their mass-to-charge ratios, and two or more ion collectors (77) for receiving ions of different mass-to-charge ratios, wherein an apertured electrically conductive sampling member (19) is provided adjacent to the plasma (3) and communicates between the plasma and a first vacuum enclosure (23) evacuated by first pumping means (25); an apertured skimmer member (28) separates the first vacuum enclosure from a second vacuum enclosure (4) evacuated by second pumping means (5); an apertured differential pumping member (6) separates the second vacuum enclosure from a third vacuum enclosure (7) evacuated by third pumping means (43); an apertured analyzer entrance member (46) separates the third vacuum enclosure from a vacuum envelope (75, 76, 77) in which the electrostatic ion-energy analyzer ion-momentum analyzer, and ion detectors are disposed, the vacuum envelope being evacuated by fourth pumping means (131); and means (40) are provided for maintaining the sampling member at a second potential whereby ions generated in the plasma pass through each of the apertures and are accelerated to have a kinetic energy suitable for their mass analysis in the ion-momentum analyzer at said first potential.

27 Claims, 6 Drawing Sheets

ISOTOPIC-RATIO PLASMA SOURCE MASS SPECTROMETER

This invention relates to a mass spectrometer for the accurate determination of isotopic ratios which is fitted with either an inductively coupled plasma (ICP) or microwave induced plasma (MIP) ion source. In particular it provides a magnetic sector mass o spectrometer having an ICP or an MIP ion source and several ion collectors to enable the simultaneous monitoring of two or more mass-to-charge ratios.

In prior multiple-collector mass spectrometers for high precision determination of isotopic composition, samples are normally ionized by thermal ionization: A solution of the sample is coated on a filament which after drying is transferred into the ion source of the mass spectrometer. After a period of evacuation and preheating to stabilize ion emission, which may last several hours, the filament is heated (by passage through it of an electrical current) to a temperature sufficient for thermal ionization of the sample to take place and to produce ions in sufficient quantity, for the isotopic analysis to be carried out. Ions so generated are typically characteristic of the isotopes present in the sample. These ions are accelerated through a fixed potential gradient and are separated according to their mass-to-charge ratios by a magnetic sector mass analyzer which has at least two collectors disposed to receive ions of different mass-to-charge ratios. In this way the ratio of the intensities of two or more ion beams of different mass-to-charge ratios may be instantaneously determined and the effect of any time-dependent fluctuation in the ionization intensity or mass spectrometer stability can be minimized. In some cases, integration of the ion current signals from a single filament may be continued for several hours in order to reduce fractionation effects and to smooth noisy signals from isotopes present in small quantities so that high precision ratios can be determined.

Sampling handling and pretreatment procedures for thermal ionization mass spectroscopy, although highly refined and capable of yielding isotopic ratios of very high precision, are elaborate and time-consuming, and typically only a few samples can be analyzed in a working day. A significant part of the analysis time is required for outgassing and preheating of the coated filament after it has been mounted in the spectrometer's ion source, and current thermal ionization spectrometers comprise magazines which allow several filaments to be loaded in the vacuum system and automatically analyzed in turn. Typically, outgassing and preheating of filament next in line for analysis is carried out while another filament is being analyzed. However, magazine systems of this kind are complicated and expensive mechanical devices and do not completely solve the problem of limited sample throughput because of the long sample preheating and measurement times that are necessary for thermal ionization. A need therefore exists for a sample ionization technique suitable for use with multiple-collector magnetic sector mass analyzers and which enables high precision isotopic-ratio measurements to be made with greater facility. It is the object of this invention to provide an isotopic-ratio mass spectrometer incorporating such a sample ionization technique. It is another object to provide a method of isotopic-ratio mass spectrometry which is capable of a greater sample throughput than prior high-precision isotopic-ratio mass spectrometers.

The invention provides an isotopic-ratio mass spectrometer comprising ion source means, an electrostatic ion-energy analyzer, a magnetic sector ion-momentum analyzer wherein ions are dispersed at a first potential according to their mass-to-charge ratios, and ion detecting means comprising two or more ion collectors for receiving ions of different mass-to-charge ratios, wherein:

a) said ion source means comprises means for establishing a plasma discharge in an inert gas by the action of an electromagnetic field created by a radio-frequency or microwave generator;

b) means are provided for introducing into said plasma a sample whose isotopic composition is to be determined;

c) an electrically conductive sampling member is provided adjacent to said plasma, said sampling member having an aperture communicating between said plasma and a first vacuum enclosure evacuated by first pumping means;

d) a skimmer member is provided downstream of said sampling member, said skimmer member separating said first vacuum enclosure from a second vacuum enclosure evacuated by second pumping means, and comprising an aperture communicating between said first and said second vacuum enclosures;

e) a differential pumping member is provided downstream of said skimmer member, said differential pumping member separating said second vacuum enclosure from a third vacuum enclosure evacuated by third pumping means, and comprising an aperture communicating between said second and said third vacuum enclosures;

f) an analyzer entrance member is provided downstream of said differential pumping member, said entrance member separating said third vacuum enclosure from a vacuum envelope in which said electrostatic ion-energy analyzer, said ion-momentum analyzer, and said ion detecting means are disposed, said vacuum envelope being evacuated by fourth pumping means and said entrance member comprising an aperture communicating between said third vacuum enclosure and said vacuum envelope; and g) means are provided for maintaining said sampling member at a second potential whereby ions generated in said plasma pass through each of said apertures and are accelerated to have a kinetic energy as they enter said ion-momentum analyzer, which energy is suitable for their mass analysis in said ion-momentum analyzer at said first potential.

Preferably, the sampling member and the skimmer member may comprise a conical nozzle-skimmer type interface having geometry similar to that used conventionally to interface a plasma to a quadrupole mass analyzer, and all the apertures may lie on an extension of the axis of the sampling member cone and skimmer member cone. The sizes of the apertures and the speeds of the pumping means may be selected so that a staged reduction of pressure is achieved from atmospheric pressure at which the plasma operates to a pressure of $10^{-8}$ torr or lower in the vacuum envelope which is necessary for high-precision isotopic-ratio determination. Typically, the first pumping means may be a mechanical rotary vacuum pump which maintains a pressure of between 1–10 torr in the first vacuum enclosure and the second and third pumping means may be diffusion or turbomolecular high-vacuum pumps. As is conventional for isotopic-ratio analyzers, the fourth pumping means may comprise one or more ion pumps, and a high vacuum isolation valve may be provided between the third vacuum enclosure and the vacuum envelope.

In further preferred embodiments, ion transport means may be provided in any or all of the first, second and third vacuum enclosures. The ion transport means may take the form of either multipolar rod or apertured electrode electrostatic lenses, and may be arranged to minimize losses of ions between the sampling and entrance members. In particular, one or more quadrupole lenses may be provided to change the shape of the ion beam from the circular section it typically possesses as a consequence of the presence of a circular aperture in the sampling member to a substantially rectangular section more suitable for a magnetic sector analyzer. Apertured electrode lenses may also be provided to control ion beam expansion and focus the ions through the various apertures.

In one embodiment of the invention the fourth pumping means may comprise a single pump which maintains the whole of the vacuum envelope at a pressure of less than $10^{-8}$ torr. In other embodiments, it may comprise two or more pumps which separately evacuate different parts of the envelope, for example the ion collector region and the electrostatic ion-energy analyzer region. Pumps may also be provided to evacuate the immediate vicinity of the entrance aperture which may be separated from the part of the vacuum envelope containing the ion-energy analyzer and ion-momentum analyzer by an additional differential pumping member. In view of the low pressure in the vacuum envelope, however, the aperture in this additional differential pumping member may be quite large.

The invention provides a convenient and rapid method of generating ions from a sample for isotopic analysis by means of a high-precision multiple-collector magnetic-sector mass analyzer of the type generally used in conjunction with a thermal ionization source. This is achieved by the use of an inductively coupled plasma (ICP) or microwave induced plasma (MIP) ion source interfaced to an isotopic-ratio mass analyzer. ICP and MIP ion sources are well known in connection with quadrupole mass spectrometers, but only recently have been successfully interfaced with magnetic sector spectrometers (see, for example, PCT application publication number WO89/12313 . Combination with a high-precision isotopic-ratio magnetic sector mass spectrometer has not been envisaged, presumably because of the incompatibility between the high-temperature plasma ion source operating at atmospheric pressure and producing a very high concentration of unwanted background ions and the absolute cleanliness and ultra-high vacuum conditions necessary for high precision isotopic-ratio determination.

The determination of isotopic ratios by quadrupole based ICPMS has been reported by several authors, for example Price Russ III and Bazan (Spectrochim. Acta, 1987 vol 42B (1-2) pp 49–62), Anderson and Gray (Proc. Analyt. Div. Chem. Soc, Sept. 1976 pp 284–287), Ting and Janghorbani (Spectrochim. Acta. 1987 vol 42B (1-1) pp 21–27), and Gregoire (Prog. Analyt. Spectrosc. 1989, vol 12 pp 433–452), but the precision obtained falls far short of that achievable with apparatus according to the present invention. Karlewski, Eberhardt, Trautmann and Hermann (Kyoto Daigaku Genshiro Jikkenso, Tech. Rep. KURRI TR318, pp 72–6) report the combination of ICP and MIP ion sources with a gas-jet transport isotopic separator (HELIOS, Universitat Mainz), but this involves the use of a two-stage pumping system having very large pumps (a 2000 $m^3$/hr mechanical pump and a 3000 l/s diffusion pump) which are impractical for use in an analytical instrument. An important difference between these prior art devices and the present invention is the provision of at least one additional stage of differential pumping, so that in the present invention at least three separately evacuated vacuum enclosures are provided between the plasma and the UHV section of the mass spectrometer. This allows the use of smaller capacity pumps than would be necessary with a two-stage system, so that an analytical-scale instrument can be built.

The ion-momentum analyzer is a magnetic sector analyzer. Although not essential, it is preferable that the electrostatic ion-energy analyzer and the magnetic sector ion-momentum analyzer are disposed in that order so that use of the multiple-collector ion detector system is facilitated. To improve the abundance sensitivity the electrostatic and magnetic analyzers may co-operate to produce in the image plane in which the ion collectors are disposed a double-focused image (i.e., both direction and energy focused) of the object aperture of the first analyzer. In common with all isotopic-ratio analyzers, however, very high mass resolution is not required. Rather, aberrations which affect the abundance sensitivity and the shape of flat-topped peaks should be minimized. The design of an ion mass analyzing means and ion detection means suitable for use in the invention may follow conventional practice.

In all magnetic sector mass spectrometers, ions must be generated at a relatively high potential (typically +4 to +8 kV) relative to the potential of the flight tube of the magnetic sector analyzer (typically ground potential) so that they are accelerated as they approach the analyzer and enter it with a fixed kinetic energy suitable for the analyzer. In thermal ionization sources this is achieved simply by maintaining the filament on which the sample is coated at the necessary accelerating potential. With a plasma ion source according to the invention, however, it is necessary to cause ions to be generated in the plasma at the required potential. This is done by maintaining the sampling member at the second potential, selected so that the difference between the first and second potentials is close to, but not necessarily equal to, the accelerating potential. The inventor has found that this results in the efficient generation of ions having energies within a sufficiently narrow range for high-precision isotopic analysis, and with sufficient stability to allow precise isotopic-ratio determination, providing that an ion-energy analyzer is also used. In the preferred form of the invention the coil or microwave cavity used to generate the field which forms the plasma, its associated electrical power supply, and the plasma torch and sample introduction system, are all maintained at ground potential. (This may be contrasted with the Karlewski isotope separator, discussed above, in which the entire plasma generation system is floated at 20 kV). A plasma interface for high-resolution magnetic sector analyzers similar to that used in the present invention is disclosed in PCT application publication number WO89/12313, and this publication gives details of how the energy of the ions generated in an ICP or MIP may be determined by selection of the potential applied to the sampling member, but it will be appreciated that prior to the development of the present invention, this technique had not been used in conjunction with an isotopic ratio analyzer.

In another preferred embodiment, ions generated in the plasma are analyzed in the magnetic sector at a first kinetic energy and in the electrostatic ion-energy analyzer at a second kinetic energy, lower than the first. In this case, when a cylindrical sector energy analyzer is employed, the strength of the electrostatic field in the energy analyzer will be substantially equal to the strength of a similar reference field multiplied by the ratio of the second and first kinetic energies, when the strength of the reference field is that necessary to deflect ions having the first kinetic energy around the central trajectory of the analyzer. In this way a sector energy analyzer having a much smaller radius can be employed. In practice, when the energy analyzer precedes the magnetic sector, ions generated the plasma are typically accelerated to a first kinetic energy by passage through a grounded aperture (typically the aperture in the differential pumping member) and are then decelerated to a second kinetic energy by a deceleration lens. They then pass through the electrostatic ion-energy analyzer, which may comprise a pair of cylindrical sector electrodes maintained at potentials so that the potential of its central trajectory corresponds with the second kinetic energy. After passing through an intermediate energy defining slit, the ions then pass through an accelerating lens whose last element is grounded and enter the magnetic sector analyzer at ground potential and with the first kinetic energy. The combination of the reduced radius energy analyzer, accelerating lens, and magnetic sector analyzer can be made double focusing in the manner described in our European patent application 91311454.2.

Viewed from another aspect the invention provides a method of high-precision isotopic analysis of a sample comprising the steps of generating ions characteristic of a said sample, selecting said ions according to their energy and dispersing them according to their mass-to-charge ratios, collecting at spatially separated positions at least some ions of at least two different mass-to-charge ratios, and determining the isotopic composition of a said sample by measurement of the ratio of the currents due to ions collected at said spatially separated positions, said method also comprising the steps of:

a) generating said ions in a plasma established in an inert gas by an electromagnetic field generated by a radio-frequency or microwave generator;

b) passing at least some of the ions so generated in sequence through:

i) an aperture in an electrically conductive sampling member adjacent said plasma into a first vacuum enclosure evacuated by first pumping means;

ii) an aperture in a skimmer member :from said first vacuum enclosure into a second vacuum enclosure evacuated by second pumping means;

iii) an aperture in a differential pumping member from said second vacuum enclosure into a third vacuum enclosure evacuated by third pumping means;

iv) an aperture in a vacuum envelope evacuated by fourth pumping means, in which envelope said ions are selected according to their energy and dispersed according to their mass-to-charge ratios; and c) maintaining said sampling member at a potential whereby ions are generated in said plasma at a first potential energy and are subsequently accelerated as they pass through said apertures to a first kinetic energy at which they are dispersed according to their mass-to-charge ratios.

In preferred methods the ions are selected according to their energy by means of an electrostatic sector energy analyzer, and then pass into a magnetic sector analyzer which disperses them according to their mass-to-charge ratios. A conventional multi-collector system is provided to receive at least two of the mass dispersed ion beams in separate collectors so that an accurate isotopic ratio can be determined. However, it is within the scope of the invention to reverse the order of the electrostatic sector and magnetic sector analyzers.

Further preferably, the method comprises generating the ions in an inductively coupled plasma or a microwave induced plasma, conveniently formed in argon, as in prior types of low-resolution ICP or MIP quadrupole mass spectrometers.

A still further preferred method according to the invention comprises decelerating the ions to a second kinetic energy after they have been accelerated to the first kinetic energy by passage through at least one of the apertures, and selecting with an electrostatic energy analyzer those ions having energies within a predetermined range of the second kinetic energy. These ions may then be accelerated to the first kinetic energy and dispersed according to their mass-to-charge ratios into at least two ion collectors, as described. This enables a smaller radius electrostatic analyzer to be employed than if the energy selection was carried out an the first kinetic energy.

An embodiment of the invention will now be described by way of example only and with reference to the drawings, in which.

Figure 1:
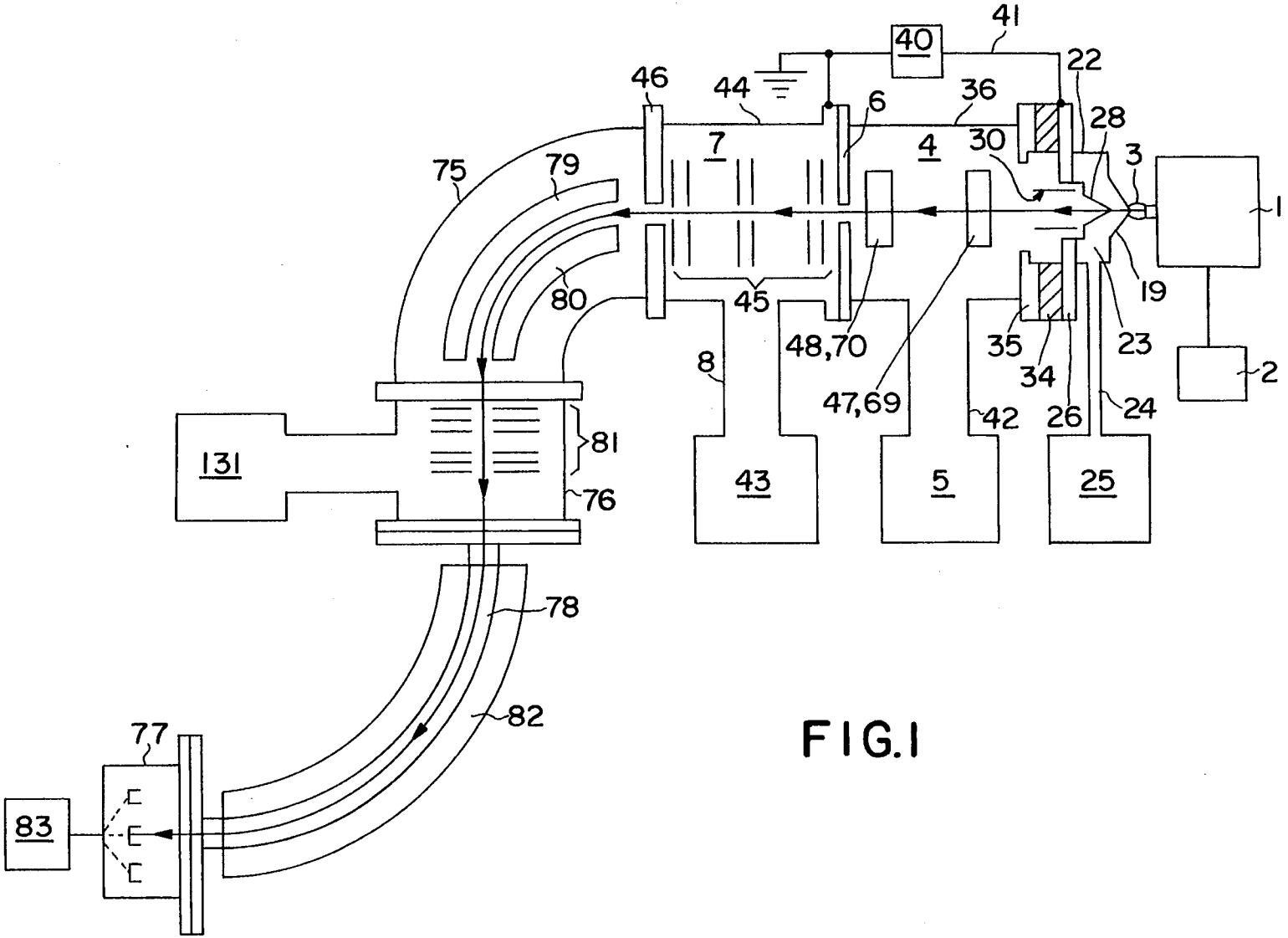
FIG. 1 is a schematic view of a mass spectrometer according to the invention.

Referring first to FIG. 1, a largely conventional inductively-coupled-plasma torch assembly 1 which is fed by a gas supply and sample introduction unit 2 generates a plasma 3 in which ions characteristic of the isotopes present in a sample are formed. Plasma 3 is formed adjacent to a sampling member 19 which consists of a hollow cone with an aperture in its apex through which the ions pass into a first vacuum enclosure 23 formed in a body 22 and evacuated by a first pumping means 25 through a pipe 24. First pumping means 25 typically comprises an 18 $m^3$/hr mechanical pump and the pressure in the enclosure 23 is typically maintained between 1 and 10 torr.

A skimmer member 28 mounted on a flange 26 separates the first vacuum enclosure 23 from a second vacuum enclosure 4 which is enclosed by housing 36 and evacuated through a port 42 by second pumping means 5, typically a 1000 l/s diffusion pump. This is capable of maintaining a pressure of between $10^{-3}$ and $10^{-4}$ torr in the second vacuum enclosure 4. Skimmer member 28 and the sampling member 19 comprise a nozzle-skimmer interface of the type used on conventional quadrupole based ICPMS instruments except that the skimmer member 28 is mounted on an insulator 34 from a flange 35 on the housing 36 so that it and the sampling member can be maintained at a high potential by a power supply 40 connected by lead 41.

The second vacuum enclosure 4 contains ion transport means comprising a tubular lens 30 and two pairs of quadrupole lenses 47, 69 and 48, 70, described in detail below. A differential pumping member 6 separates the second vacuum enclosure 4 from a third vacuum enclosure 7 which is evacuated through a pumping port 8 on a housing 44 by a third pumping means 43, typically a 220 l/s turbomolecular pump. The third vacuum enclosure 7 is maintained at approximately $10^{-7}$ torr by the pumping means 43, and contains a decelerating lens assembly described in detail below.

An analyzer entrance member 46 separates the third vacuum enclosure 7 from the vacuum envelope which encloses the UHV portion of the mass spectrometer. This envelope comprises the housings 75, 76, 77 and the flight tube 78. The housing 76, and therefore the entire vacuum envelope, is evacuated by fourth pumping means 131, typically an ion pump capable of maintaining a pressure of less than $10^{-8}$ torr throughout the envelope. An additional ion pump (not shown) may be used to evacuate housing 77 if desired, and an isolation valve may be installed at either or both of the members 46 or 6 to facilitate service work on the inlet system while maintaining the vacuum envelope at UHV.

Housing 75 contains an electrostatic ion-energy analyzer comprising two cylindrical sector electrodes 79, 80 described in detail below. After energy selection the ion beam continues into an accelerating lens assembly 81 disposed in housing 76 and into the flight tube 78. A magnetic field is generated between magnet poles 82 which disperses the ions according to their mass-to-charge ratios. Housing 77 contains at least two ion collectors (three are illustrated) which receive ion beams of at least two different mass-to-charge ratios. Electrical signals from these ion collectors are amplified by a multiple-channel amplifier and signal display system 83. Item numbers 78, 82, 77 and 83 comprise the magnetic sector analyzer and multiple-collector system of a conventional high-precision isotopic-ratio mass spectrometer and need not be described in detail.

In accordance with the invention the power supply 40 maintains the sampling member 19 at a second potential, selected so that the difference between the second potential and the first potential (ground) at which the flight tube 78, ion collection system and housings 75,76 and 77 are maintained is such that the ions generated in the plasma are accelerated to a first kinetic energy as they pass through any of the grounded apertures. In this way the ions are dispersed according to their mass-to-charge ratios by the magnetic field (generated between the magnet poles 82) at the first kinetic energy. Although it is within the scope of the invention to carry out energy selection (by the electric field between the sector electrodes 79) at the same (i.e., the first) kinetic energy by omission of the decelerating and accelerating lens assemblies 45 and 81 (i.e., as in a conventional double-focusing mass analyzer), in the FIG. 1 embodiment the energy selection is carried out at a second kinetic energy (lower than the first) so that a smaller radius electrostatic ion-energy analyzer can be employed. Thus the last element of the deceleration lens assembly 45, and the aperture in the differential pumping member 46, are maintained at a third potential, intermediate between the first (ground) and second (sampling member) potentials, so that ions enter the energy analyzer at a second kinetic energy. The sector electrodes 79, 80 are maintained at potentials so that the central trajectory between them is at that third potential, and the first element of the accelerating lens 81 is also maintained at the third potential. The last element of lens 81 is maintained at the first (ground) potential so that the ions leaving the energy analyzer are reaccelerated to the first kinetic energy.

The invention is not limited to the provision of a single pump for evacuation of the vacuum envelope as shown in FIG. 1. For example, an additional ion pump may be provided to evacuate the collector housing 77 and other pumps may be provided to evacuate the housing 75. Additional differential pumping members may be provided between the various stages, although in view of the very low pressures in the envelope, these may comprise fairly large apertures.

Figure 2:
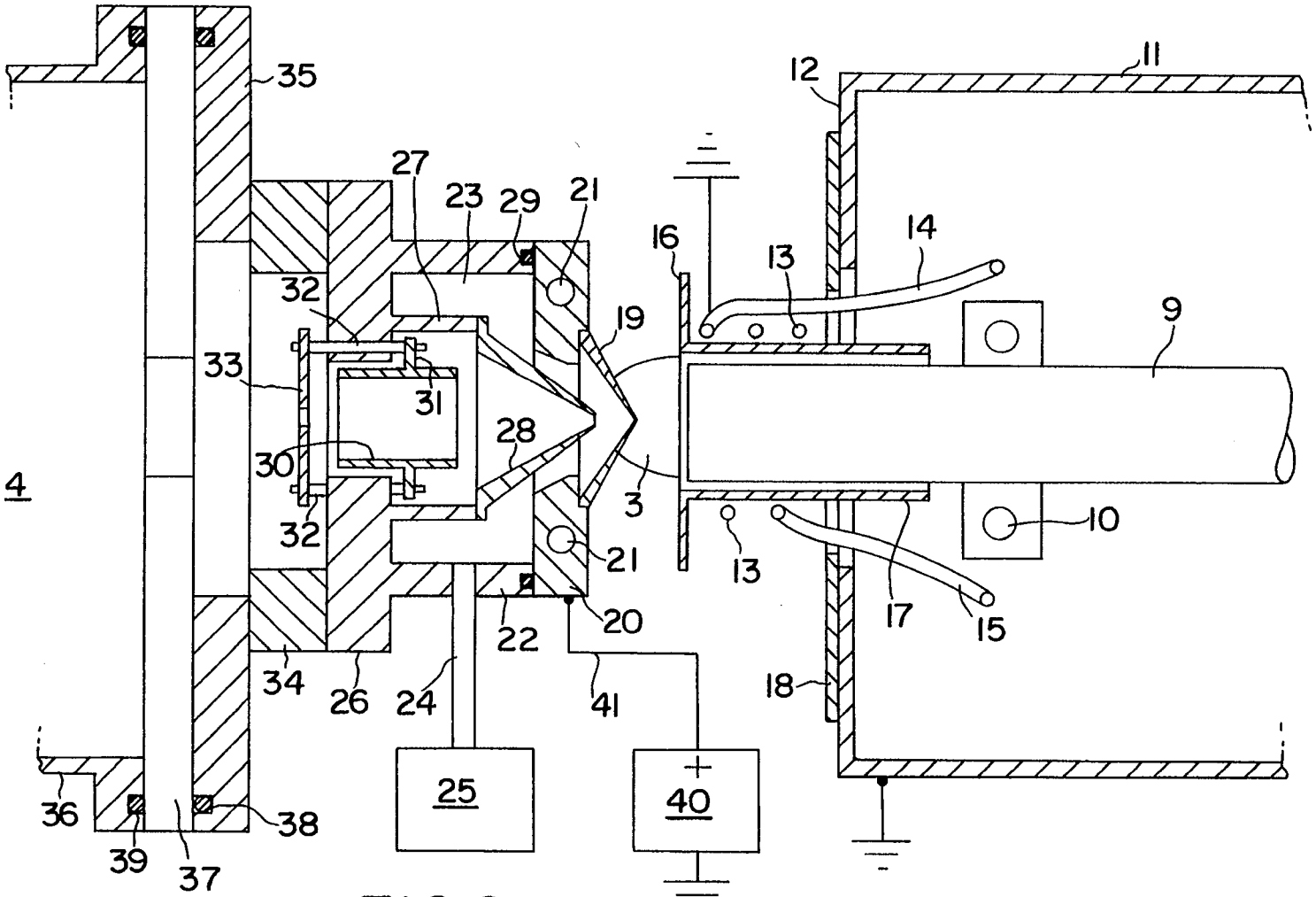
FIG. 2 is a sectional view of a plasma generator and sampling system of the spectrometer of FIG. 1.

FIG. 2 illustrates the construction of the nozzle-skimmer region in more detail. Plasma 3 is generated by a conventional inductively-coupled plasma torch 9 fixed by a mounting clamp 10 inside a metal torch box 11 but is arranged to protrude from the front face 12 of the box 11 by approximately 30 mm. The RF load coil 13 is mounted at least partly outside box 11 and is connected by conductive tubes 14, 15 to the output terminals of an RF generator (not shown) inside box 11. Coil 13 is formed from a hollow tube to enable cooling water to be passed through it via the conductive tubes 14 and 15, and is grounded as indicated in FIG. 2. A quartz bonnet comprising a cylindrical portion 17 and a flat circular portion 16 is a push fit between the torch 9 and the coil 13. An insulator 18 (typically ceramic) is attached to the front face 12 of box 11.

The sampling member 19 may conveniently comprise a nickel cone with an external angle of approximately 120° and with an aperture approximately 1.0 mm diameter in its apex. It is mounted on a front plate 20 which comprises drilled passages 21 through which cooling Water may be circulated. The plate 20 is mounted on the body 22 in which the first vacuum enclosure 23 is formed. An 'O' ring 29 is used to seal plate 20 to the body 22. As the sampling member 19 is maintained at a high potential by power supply 40, and the pressure in enclosure 23 is typically 1–10 torr, it may be necessary to insulate the first pumping means 25 from ground.

Body 22 also comprises a circular flange 26 and a concentrically disposed inner circular portion 27 which supports the skimmer member 28, typically a hollow cone of about 55° external angle with a hole in its apex, as in a conventional ICP quadrupole mass spectrometer. Other, higher performance, skimmer members suitable for use in the invention are disclosed in PCT application publication number WO90/09031. A hollow cylindrical lens element 30 is mounted by three lugs 31 disposed at 120° to each other on insulated mountings 32 from the flange 26. The insulating mountings 32 extend through the flange 26 and support a second lens element 33. Lens elements 30 and 33 are provided to improve the transmission efficiency of ions emerging from the skimmer member 28 into the second vacuum enclosure 4.

Flange 26 is attached to an insulator 34 which is in turn attached to the flange 35 of the housing 36 of the second vacuum enclosure 4. A spacer 37, sealed by 'O' rings 38, 39, is also included in the assembly and may be replaced by a vacuum isolation slide valve if desired. More details of the construction of the nozzle-skimmer portion of the invention, and the means of generating ions at the second potential which allows them to be accelerated to the first kinetic energy, may be found in PCT application number WO 89/12313.

Figure 3:
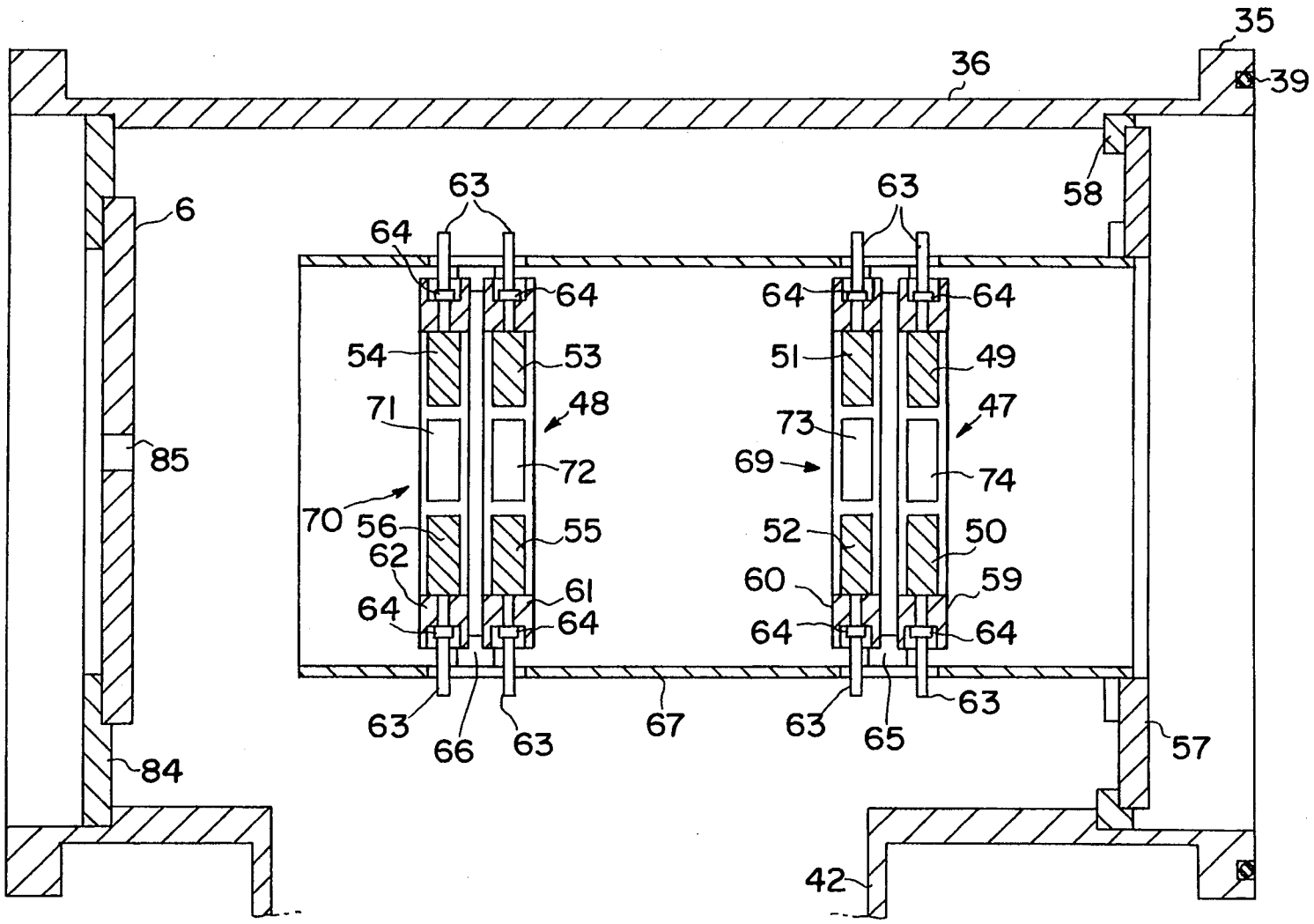
FIG. 3 is a sectional view of a system of electrostatic lenses suitable for use with the spectrometer of FIG. 1.

FIG. 3 illustrates details of the quadrupole lens assemblies 70, 48, 69 and 47 housed in the second vacuum enclosure 4. Assemblies 70, 48, 69 and 47 are mounted in a support tube 67 which is in turn supported on a flange 57 fixed to another flange 58 inside the housing 36. Each lens assembly comprises four short circular cross-section rod electrodes (e.g., 49–56, 71–74) which are mounted from a ceramic support insulator 59–62 by means of studding 63 secured by a nut and washer 64 in a recess in the insulator. The rods are disposed so that their axes are parallel to the axis of the support tube 67 and so that imaginary lines joining the centers of oppositely disposed rods in each lens are aligned with the boundaries of the rectangular cross-section ion beam which is formed by the lens assemblies and which enters the momentum and energy analyzers. Each of the support insulators 59–62 is clamped against a recessed flange 65, 66 fitted inside the tube 67 to locate the lens assemblies. The potentials applied to the electrodes of the lens assemblies are adjusted to efficiently transmit ions through the second vacuum enclosure 4 and convert the cross section of the beam from circular to substantially rectangular. This type of beam shaping lens is well known in the art and its operation need not be described in detail.

Figure 4:
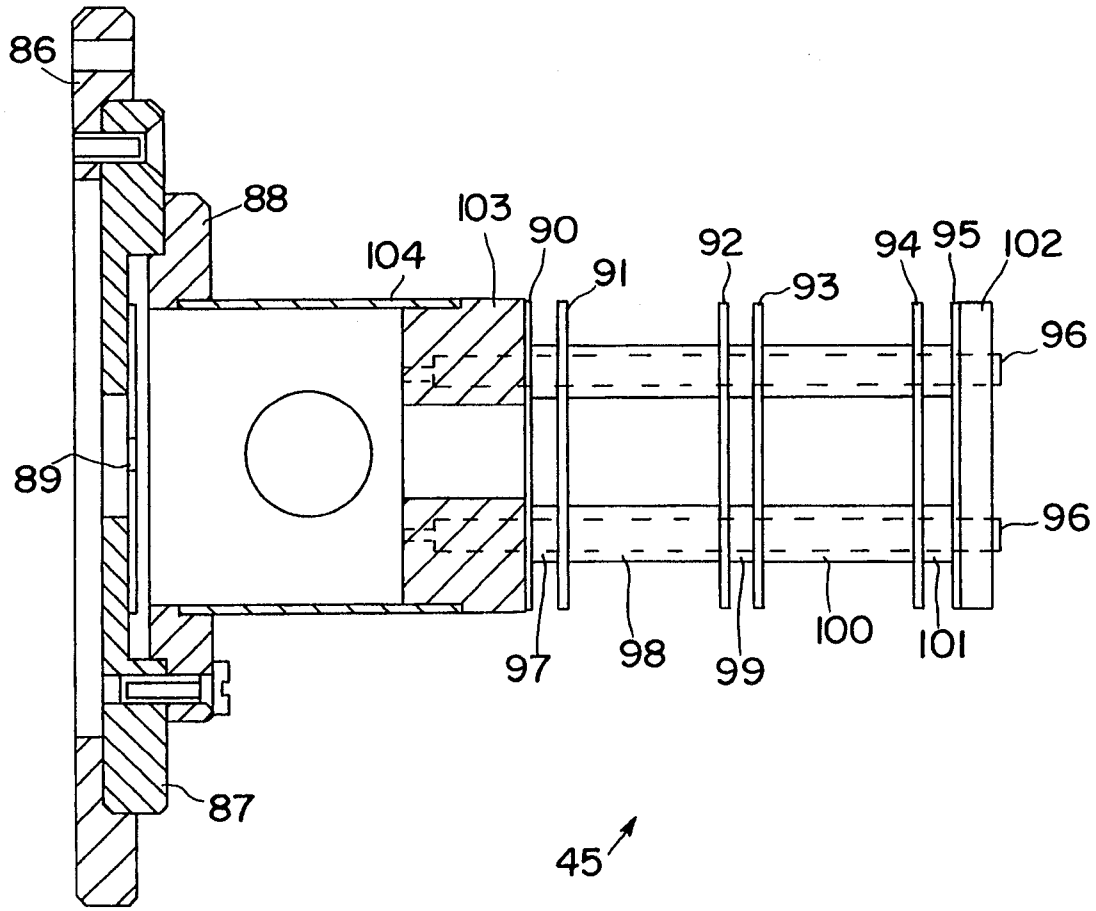
FIG. 4 is a view of a deceleration lens suitable for use in the spectrometer of FIG. 1.

The second vacuum enclosure 4 is separated from the third vacuum enclosure 7 by means of a differential pumping member 6 mounted on an internal flange 84 fitted inside the housing 36 and comprising an aperture 85 through which ions pass into the decelerating lens assembly 45 in the housing 44. FIG. 4 is a drawing of the assembly 45. It is mounted from a flange 86 which is secured to the entrance aperture member 46 between the third vacuum enclosure 7 and the vacuum envelope comprising housings 75, 76, 77 and the flight tube 78. Flange 86 supports an insulating flange 87 which in turn supports a lens mounting flange 88 and a thin plate comprising the entrance aperture 89 of the electrostatic ion-energy analyzer. Flange 88 and the plate in which aperture 89 is formed are maintained at the third potential so that ions leave aperture 89 with the second kinetic energy, as explained. The remaining lens elements 90–95 are supported on four ceramic rods 96 and spaced apart by tubular insulators 97–101. The assembly is clamped by a clamping ring 102 and the rods 96 are supported in a rod support 103 mounted on a tube 104 attached to the flange 88. The potentials applied to the lens elements 91–95 are selected to focus ions on to the entrance aperture 89. Element 90 and the flange 88 are of course maintained at the third potential.

Figure 5B:
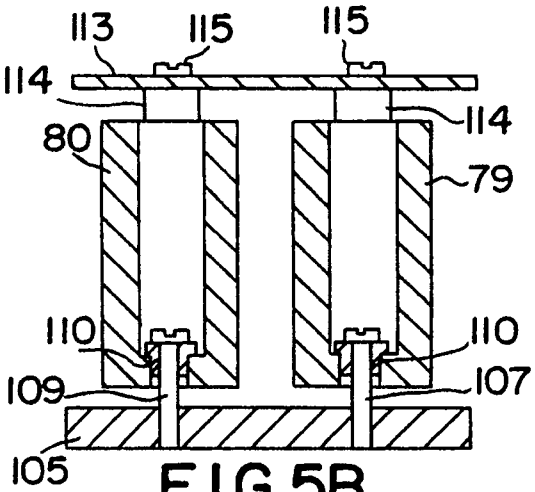
FIGS. 5B and 5C are sectional views taken on lines A—A and B—B in FIG. 5A, respectively.
Figure 5C:
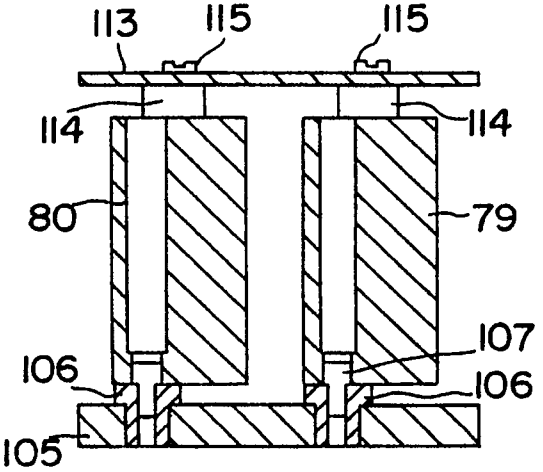
Figure 5A:
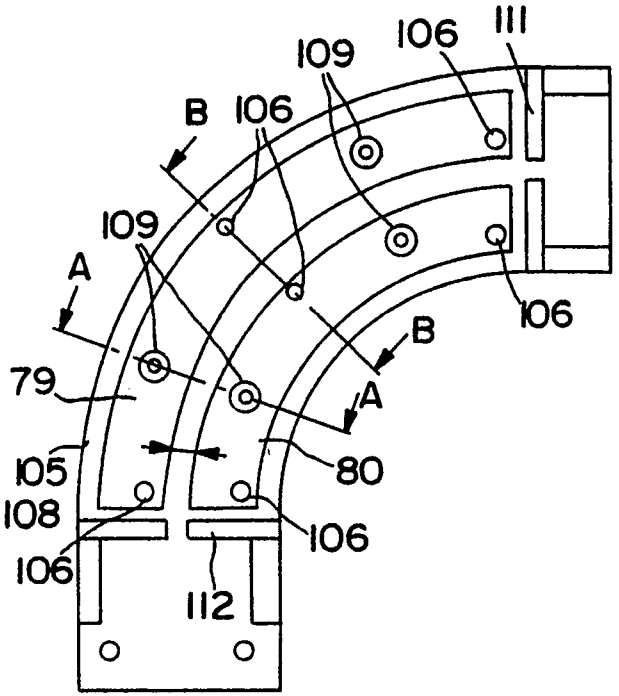
FIG. 5A is a sectional view of an electrostatic ion-energy analyzer suitable for use in the spectrometer of FIG. 1.

Ions emerging through aperture 89 pass into the electrostatic ion-energy analyzer comprising the cylindrical sector electrodes 79, 80 which is shown in FIGS. 5A–5C. Each electrode 79, 80 is supported on a baseplate 105 mounted inside the housing 75 on stepped ceramic insulators 106 and located by dowels 107 so that a gap 108 of constant width is formed between electrodes 79 and 80. The electrodes are fastened to the baseplate 105 by screws 109 and insulators 110. Entrance and exit fringing field correctors (111 and 112 respectively) are fitted as shown in FIG. 5A. A cover plate 113 (FIGS. 5B, 5C) is supported from the electrodes 79, 80 by means of insulators 114 and screws 115. The assembly comprising baseplate 105, cover plate 113, and the fringing field correctors 111, 112 is mounted from an insulating flange (not shown) inside the housing 75 so that it can be maintained at the third potential.

Figure 6:
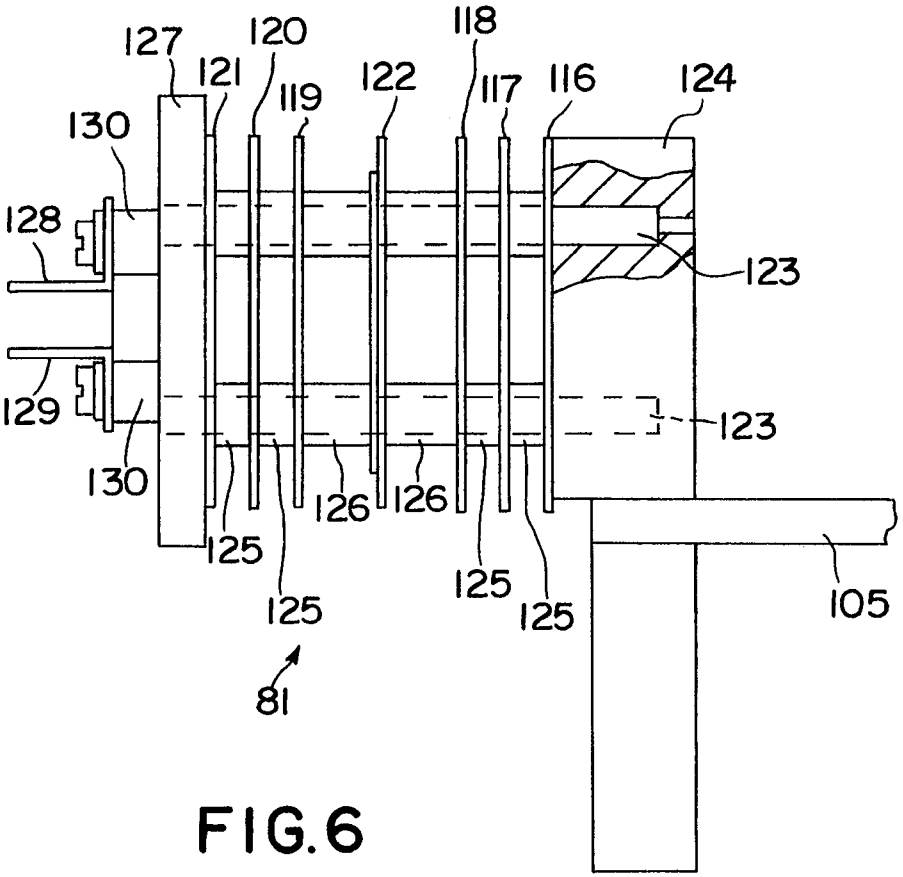
FIG. 6 is a view of an acceleration lens suitable for use in the spectrometer of FIG. 1.

Mounted from the end of the baseplate 105 is the accelerating lens assembly 81, illustrated in detail in FIG. 6. It comprises two three-element lenses formed by electrodes 116–121 and an intermediate energy-defining slit formed in plate 122. The electrodes 116–121 and the plate 122 are supported on four ceramic rods 123 mounted in a support block 124 attached to the end of the baseplate 105 and separated by tubular short and long insulated spacers (125 and 126 respectively). The electrodes are maintained in position by a clamping ring 127 which also supports a pair of "z" deflection electrodes 128, 129 on insulators 130. The first element 116 of assembly 81 and the support block 123 are maintained at the third potential by virtue of their attachment to the baseplate 105. The final element 121 is maintained at ground potential so that ions leave the assembly 81 at the first kinetic energy, ready for analysis in the magnetic sector analyzer which follows. The energy passband of the analyzer is selected by fitting slits of different width at plate 122, and potentials on the electrodes 117–120 are selected to optimize the ion transmission. A small potential difference, balanced about ground, may be applied to the "z" deflection electrodes 128, 129 to ensure the ions are travelling in the plane of the flight tube 78 as they enter the magnetic sector analyzer.

After they leave the accelerating lens assembly 81, the ions are dispersed according the their mass-to-charge ratios in the flight tube 78 by a magnetic field generated between the magnet poles 82. The mass dispersed ion-beam enters the ion collector housing 77 where it is received by at least two ion collectors which are positioned to received ion beams of different mass-to-charge ratios. Electrical signals from the ion collectors are separately amplified and combined in the amplifier and display system 83. The magnetic sector analyzer and its associated ion collection, control and data acquisition systems are those of a conventional high-precision isotopic-ratio analyzer of the type used with thermal ionization sources, and need not be described in detail.

In the embodiment shown in FIG. 1 the geometrical parameters of the analyzers and the potentials applied to the lenses comprised in the accelerating lens assembly 81 are selected so that the combination of the electrostatic ion-energy analyzer, accelerating lens and magnetic sector analyzer forms a mass-dispersed direction- and velocity-focused image in the plane in which the ion collectors are disposed. It is, however, possible to use a conventional double-focusing isotopic-ratio analyzer, in which the ion energy selection is carried out at the same energy as the dispersion according to mass-to-charge ratio, by omitting the decelerating and accelerating lens assemblies 45 and 81 and replacing them by transmission lens assemblies in which the ions enter and leave with the same energy. In such an arrangement, the lens assembly 81 may in fact be completely omitted if the geometrical arrangement of the analyzers is adjusted accordingly. Further, it is not essential that the analyzer arrangement is double-focusing, although this is highly desirable.

Samples for isotopic analysis may be introduced into the plasma 3 by any of the means conventionally used for conventional ICPMS systems. Solutions of samples may be nebulized and introduced into the torch 9 as an aerosol, or a laser may be used to ablate samples from the surface of a solid. Electrothermal vaporization may also be employed. All of these methods are well known. Therefore, by employing the apparatus and method of the invention it is possible to measure isotopic ratios more quickly than with thermal-ionization mass spectrometry and with much greater accuracy than is possible with quadrupole ICP mass spectrometers.

I claim:

1. An isotopic-ratio mass spectrometer comprising ion source means, an electrostatic ion-energy analyzer, a magnetic sector ion-momentum analyzer wherein ions are dispersed at a first potential according to their mass-to-charge ratios, and ion detecting means comprising two or more ion collectors for receiving ions of different mass-to-charge ratios, wherein:

a) said ion source means comprises means for establishing a plasma discharge in an inert gas by the action of an electromagnetic field created by a radio-frequency or microwave generator;

b) means are provided for introducing into said plasma a sample whose isotopic composition is to be determined;

c) an electrically conductive sampling member is provided adjacent to said plasma, said sampling member having an aperture communicating between said plasma and a first vacuum enclosure evacuated by first pumping means;

d) a skimmer member is provided downstream of said sampling member, said skimmer member separating said first vacuum enclosure from a second vacuum enclosure evacuated by second pumping means, and comprising an aperture communicating between said first and said second vacuum enclosures;

e) a differential pumping member is provided downstream of said skimmer member, said differential pumping member separating said second vacuum enclosure from a third vacuum enclosure evacuated by third pumping means, and comprising an aperture communicating between said second and said third vacuum enclosures;

f) an analyzer entrance member is provided downstream of said differential pumping member, said entrance member separating said third vacuum enclosure from a vacuum envelope in which said electrostatic ion-energy analyzer, said ion-momentum analyzer, and said ion detecting means are disposed, said vacuum envelope being evacuated by fourth pumping means and said entrance member comprising an aperture communicating between said third vacuum enclosure and said vacuum envelope; and g) means are provided for maintaining said sampling member at a second potential whereby ions generated in said plasma pass through each of said apertures and are accelerated to have a kinetic energy as they enter said ion-momentum analyzer, which energy is suitable for their mass analysis in said ion-momentum analyzer at said first potential.

2. An isotopic-ratio mass spectrometer as claimed in claim 1 wherein the sampling member and skimmer member comprise a conical nozzle-skimmer interface and all said apertures lie on an extension of the axis of the sampling member cone and skimmer member cone.

3. An isotopic-ratio mass spectrometer as claimed in claim 2 wherein the sizes of the apertures and the speeds of the pumping means are selected so that a staged reduction of pressure is achieved from atmospheric pressure at which the plasma operates to a pressure which does not exceed $10^{-8}$ torr in the vacuum envelope.

4. An isotopic-ratio mass spectrometer as claimed in claim 3 wherein the first pumping means comprises a mechanical rotary pump and the second and third pumping means comprise diffusion or turbomolecular high vacuum pumps.

5. An isotopic-ratio mass spectrometer as claimed in claim 2 wherein ion transport means are provided in one or more of said first, second and third vacuum enclosures.

6. An isotopic-ratio mass spectrometer as claimed in claim 5 Wherein one or more quadrupole lenses are provided to change the shape of the ion beam from a circular section to a substantially rectangular section.

7. An isotopic-ratio mass spectrometer as claimed in claim 2 further comprising an additional apertured differential pumping member between the analyzer entrance member and the part of the vacuum envelope containing the ion-energy analyzer and ion-momentum analyzer.

8. An isotopic-ratio mass spectrometer as claimed in claim 2 wherein the magnetic sector analyzer, the means for generating the field which establishes the plasma discharge and its associated electrical power supply, and the sample introducing means are all maintained at ground potential.

9. An isotopic-ratio mass spectrometer as claimed in claim 2 wherein the electrostatic ion-energy analyzer and the magnetic sector analyzer are disposed in that order in the direction of ion travel.

10. An isotopic-ratio mass spectrometer as claimed in claim 2 wherein ions generated in the plasma are analyzed in the magnetic sector at a first kinetic energy and in the electrostatic ion-energy analyzer at a second kinetic energy, lower than the first.

11. An isotopic-ratio mass spectrometer as claimed in claim 1 wherein the sizes of the apertures and the speeds of the pumping means are selected so that a staged reduction of pressure is achieved from atmospheric pressure at which the plasma operates to a pressure which does not exceed $10^{-8}$ torr in the vacuum envelope.

12. An isotopic-ratio mass spectrometer as claimed in claim 11 wherein the first pumping means comprises a mechanical rotary pump and the second and third pumping means comprise diffusion or turbomolecular high vacuum pumps.

13. An isotopic-ratio mass spectrometer as claimed in claim 1 wherein ion transport means are provided in one or more of said first, second and third vacuum enclosures.

14. An isotopic-ratio mass spectrometer as claimed in claim 13 wherein one or more quadrupole lenses are provided to change the shape of the ion beam from a circular section to a substantially rectangular section.

15. An isotopic-ratio mass spectrometer as claimed in claim 1 further comprising an additional apertured differential pumping member between the analyzer entrance member and the part of the vacuum envelope containing the ion-energy analyzer and ion-momentum analyzer.

16. An isotopic-ratio mass spectrometer as claimed in claim 1 wherein the magnetic sector analyzer, the coil or microwave cavity used to generate the field which forms the plasma, its associated electrical power supply, and the plasma torch and sample introduction system, are all maintained at ground potential.

17. An isotopic-ratio mass spectrometer as claimed in claim 1 wherein the electrostatic ion-energy analyzer and the magnetic sector analyzer are disposed in that order in the direction of ion travel.

18. An isotopic-ratio mass spectrometer as claimed in claim 17 comprising a deceleration lens and an acceleration lens respectively disposed before and after the electrostatic analyzer in the direction of ion travel, whereby ions generated in the plasma and accelerated to a first kinetic energy may be decelerated by the deceleration lens to a second kinetic energy for passage through the electrostatic analyzer and may be accelerated to the first kinetic energy by the acceleration lens for passage through the magnetic sector analyzer.

19. An isotopic-ratio mass spectrometer as claimed in claim 1 wherein ions generated in the plasma are analyzed in the magnetic sector at a first kinetic energy and in the electrostatic ion-energy analyzer at a second kinetic energy, lower than the first.

20. A method of high-precision isotopic analysis of a sample comprising the steps of generating ions characteristic of a said sample, selecting said ions according to their energy and dispersing them according to their mass-to-change ratios, collecting at spatially, separated positions at least some ions of at least two different mass-to-charge ratios, and determining the isotopic composition of a said sample by measurement of the ratio of the currents due to ions collected at said spatially separated positions, said method also comprising the steps of:

a) generating said ions in a plasma established in an inert gas by an electromagnetic field generated by a radio-frequency or microwave generator;

b) passing at least some of the ions so generated in sequence through;

i) an aperture in an electrically conductive sampling member adjacent said plasma into a first vacuum enclosure evacuated by first pumping means;

ii) an aperture in a skimmer member from said first vacuum enclosure into a second vacuum enclosure evacuated by second pumping means;

iii) an aperture in a differential pumping member from said second vacuum enclosure into a third vacuum enclosure evacuated by third pumping means;

iv) an aperture in a vacuum envelope evacuated by fourth pumping means, in which envelope said ions are selected according to their energy and dispersed according to their mass-to-charge ratios; and c) maintaining said sampling member at a potential whereby ions are generated in said plasma at a first potential energy and are subsequently accelerated as they pass through said apertures to a first kinetic energy at which they are dispersed according to their mass-to-charge ratios.

21. A method as claimed in claim 20 wherein the ions are selected according to their energy by means of an electrostatic sector energy analyzer, and subsequently pass into a magnetic sector analyzer which disperses them according to their mass-to-charge ratios.

22. A method as claimed in claim 20 comprising generating the ions in an inductively coupled plasma.

23. A method as claimed in claim 20 comprising decelerating the ions to a second kinetic energy after they have been accelerated to the first kinetic energy by passage through at least one of the apertures, selecting with an electrostatic energy analyzer those ions having energies within a predetermined range of the second kinetic energy, accelerating the ions to the first kinetic energy and dispersing them according to their mass-to-charge ratios into at least two ion collectors.

24. A method as claimed in claim 21 comprising generating the ions in an inductively coupled plasma.

25. A method as claimed in claim 20 comprising generating the ions in a microwave induced plasma.

26. A method as claimed in claim 21 comprising generating the ions in a microwave induced plasma.

27. A method as claimed in claim 21 comprising decelerating the ions to a second kinetic energy after they have been accelerated to the first kinetic energy by passage through at least one of the apertures, selecting with an electrostatic energy analyzer those ions having energies within a predetermined range of the second kinetic energy, accelerating the ions to the first kinetic energy and dispersing them according to their mass-to-charge ratios into at least two ion collectors.

* * * * *

UNITED STATES PATENT AND TRADEMARK OFFICE

CERTIFICATE OF CORRECTION

PATENT NO. : 5,352,893

DATED : October 4, 1994

INVENTOR(S) : Philip A. Freedman

It is certified that error appears in the above-indentified patent and that said Letters Patent is hereby corrected as shown below:

Column 1, line 9, delete "o".

Column 5, line 19, after "generated" insert --in--; line 57, change ":from" to --from--.

Column 6, line 33, change "an" to --at--.

Column 7, line 22, insert --45,-- after "assembly".

Column 8, line 47, change "Water" to --water--.

Column 12, line 23, change "Wherein" to --wherein--.

Column 13, line 35, change "mass-to-change" to --mass-to-charge--; line 46, change "through;" to --through:--.

Signed and Sealed this

Twenty-eighth Day of November 1995

*Attest:*

Bruce Lehman

BRUCE LEHMAN

*Attesting Officer*

*Commissioner of Patents and Trademarks*